US005448320A

United States Patent [19]

Sakai et al.

[11] Patent Number: 5,448,320

[45] Date of Patent: Sep. 5, 1995

[54] AUTOMATIC SURVEILLANCE CAMERA EQUIPMENT AND ALARM SYSTEM

[75] Inventors: Yoshikazu Sakai, Kagamihara; Hogara Nagashima, Toyoake; Masahiko Amaike, Yokohama; Hisao Nagashima, Toyoake, all of Japan

[73] Assignee: NGK Insulators, Ltd., Nagoya, Japan

[21] Appl. No.: 357,134

[22] Filed: Dec. 15, 1994

Related U.S. Application Data

[63] Continuation of Ser. No. 103,217, Aug. 9, 1993, abandoned.

[30] Foreign Application Priority Data

Aug. 21, 1992 [JP] Japan ..... 4-222929

[51] Int. Cl.[6] ..... G03B 29/00

[52] U.S. Cl. ..... 354/81

[58] Field of Search ..... 354/75, 76, 81; 358/108

[56] References Cited

U.S. PATENT DOCUMENTS

| | | | |
|---|---|---|---|
| 4,525,047 | 6/1985 | Myers | 354/173 |
| 5,045,702 | 9/1991 | Mulleer | 250/342 |
| 5,101,194 | 3/1992 | Sheffer | 341/567 |
| 5,155,474 | 10/1992 | Park et al | 354/75 X |

FOREIGN PATENT DOCUMENTS

| | | |
|---|---|---|
| 1-69221 | 5/1989 | Japan . |
| 1-169229 | 11/1989 | Japan . |
| 3-20728 | 1/1991 | Japan . |
| 2202954 | 10/1988 | United Kingdom . |
| 2257257 | 1/1993 | United Kingdom . |

OTHER PUBLICATIONS

Patent Abstracts of Japan, JP-A-4 218,888, Aug. 10, 1992.

Patent Abstracts of Japan, JP-A-3 20,728, Jan. 29, 1991.

*Primary Examiner*—Howard B. Blankenship

*Attorney, Agent, or Firm*—Ronald J. Kubovcik

[57] ABSTRACT

A automatic surveillance camera equipment contains an infrared ray detecting sensor having a plurality of sensing zones and for detecting an intruder within a watching area and transmitting its signal to a control device, a control device for sending a command signal to a camera unit in response to the signal from the infrared ray detecting sensor, a camera unit for supplying a response signal to a camera in response to the command signal from the control device, a camera for synchronizing a strobe and a camera shutter each other by the response signal from the camera unit, automatically shooting, and automatically rewinding a film simultaneously together in a protective case, and is intended to perform photography of an intruder on each of the sensing zones of the infrared sensor when the intruder enters the watching area. An alarm system is directly communicated to the outside through a telephone line to transmit a signal.

8 Claims, 3 Drawing Sheets

AUTOMATIC SURVEILLANCE CAMERA EQUIPMENT AND ALARM SYSTEM

This application is a continuation of application Ser. No. 08/103,217 filed Aug. 9, 1993 now abandoned.

BACKGROUND OF THE INVENTION

1. Field of the Invention

The present invention relates to a automatic surveillance camera equipment which can shoot a plurality of sensing zones one by one by using an infrared ray detecting sensor and contains all major devices within a protective case, and relates to an alarm system including said equipment.

2. Description of the Related Art

Hitherto, crime-prevention camera systems have been employed which shoot or photograph watching areas by using video cameras or movie cameras at periodic intervals. In addition, crime-prevention camera systems also have been employed which sense entering of an intruder by a sensor, send a signal to a crime-prevention camera through a control device to shoot or photograph the intruder, and simultaneously transmits an alarm to a control center.

However, in the case of the above method which shoots a watching area with a conventional video camera or movie camera at periodic intervals, unnecessarily wasteful pictures frequently have been shot. Moreover, in the method using a video camera, a watching area which may be photographed needs illuminating always at a required level, and resolution of an image which is formed by a signal is low, thus, it is difficult to ascertain the person, etc. shown in the photograph even if he is in proper illuminance, and there is also a problem which the photograph is difficult to be accepted as legitimate evidence.

In addition, in tile conventional system, the automatic surveillance camera equipment takes one or more pictures continuously at its position at the time of sensing, but can not shoot at a position where the intruder has moved further. There also has been a problem that its function stops when electrical wiring is cut by an intruder.

The present inventor has studied about the above-mentioned problems, and has found that photography may be properly, safely performed by containing an infrared ray detecting sensor having a plurality of sensing zones, a control device, a camera unit, and a camera and so on together in a protective case that is operative even if an intruder moves, thus the present invention has been attained.

SUMMARY OF THE INVENTION

According to the present invention, there is provided a automatic surveillance camera equipment which comprises:

an infrared ray detecting sensor having a plurality of sensing zones, and for detecting an intruder within a watching area and transmitting its signal to a control device;

a control device for sending a command signal to a camera unit in response to the signal from the infrared sensor;

a camera unit for supplying a response signal to a camera in response to the command signal from the control device;

a camera for synchronizing a strobe and a camera shutter with each other by the response signal from the camera unit, automatically shooting, and automatically rewinding a film simultaneously; and a protective case for accommodating the infrared ray detecting sensor, the control device, tile camera unit and the camera together, whereby the equipment is intended to perform photography of an intruder on each of tile sensing zones of the infrared ray detecting sensor when the intruder enters the watching area.

When an intruder enters a watching area, the automatic surveillance camera equipment according to the present invention allows an infrared ray detecting sensor which has a plurality of sensing zones and senses an object over a wide range, to detect an intruder every time when tile intruder moves from a zone to a zone and to send a signal to a control device, thereby, the device feeds a command signal to a camera unit, then the camera unit transmits a response signal to a camera in response to the command signal, the camera shoots a predetermined number of pictures by synchronizing a strobe and a camera shutter with each other, thus a variety of information of the intruder and the intruder's attitude within a watching area, can be exactly obtained.

Additionally, tile automatic surveillance camera equipment according to the present invention contains major devices such as an infrared ray detecting sensor, a control device, a camera unit, a camera etc. together in a protective case, and further a battery in the protective case if necessary. Moreover, the equipment also may be interlinked so that an alarm bell sounds if an intruder touches the protective case to break the equipment, there is therefore no possibility the system is smashed by the intruder.

In the case where an emergency battery is built into an equipment, which is operative even if power supply from outside stops in power failure and so on, then its function is never disabled even though wiring is cut by an intruder. The automatic surveillance camera equipment usually operates the above infrared ray detecting sensor and control device by connecting them to an outside power source, and a built-into battery automatically starts to operate each of the devices in the equipment in an emergency, e.g., when an intruder cuts off its wiring to an outside power source.

The automatic surveillance camera equipment according to the present invention can obtain distinct images by a negative color film, and also can shoot pictures of an intruder without being suspected by him, with an infrared strobe and film being charged. Moreover, a camera records a date, hour, and minute of his intrusion on the film, which may be therefore presented as evidence.

And further, an exposed roll film preferably may be automatically rewound so as to be hold in a patrone when another film is loaded into a camera, this enables the exposed film to be protected in case of breakage of the camera, and a voltage applied to a strobe preferably is raised to about 300 volts so as to strengthen lighting to be able to shoot up to a more distant range, this allows threatening an intruder and also has an effect of preventing the equipment from being damaged by the intruder.

In addition, the operations such as starting and release are performed by employing a ciphered identification number system with a ten-key pad to prohibit being used by outsiders, and it is also possible to operate an equipment from outside by using an outside light emitting device (for example, an infrared ray emitting device) and transmitting a signal to a light-receiving section (element) equipped with the automatic surveillance camera equipment, instead of wiring. Additionally, the automatic surveillance camera equipment may be incorporated into a transmitting/receiving system, which includes a receiver for automatically receiving a signal of a notice from an infrared ray detecting sensor through a transmitter over a telephone line, for accumulating data from its information, and for performing an indication and printing corresponding to a predetermined processing of data. The system allows direct connection to a manager being outside, a security company, and a police station, thus a crime-prevention system of a larger scale also may be formed.

DESCRIPTION OF THE PREFERRED EMBODIMENT

The present invention will be described in more detail in reference with illustrative embodiments hereafter, while it is not limited to those embodiments.

Figure 1:
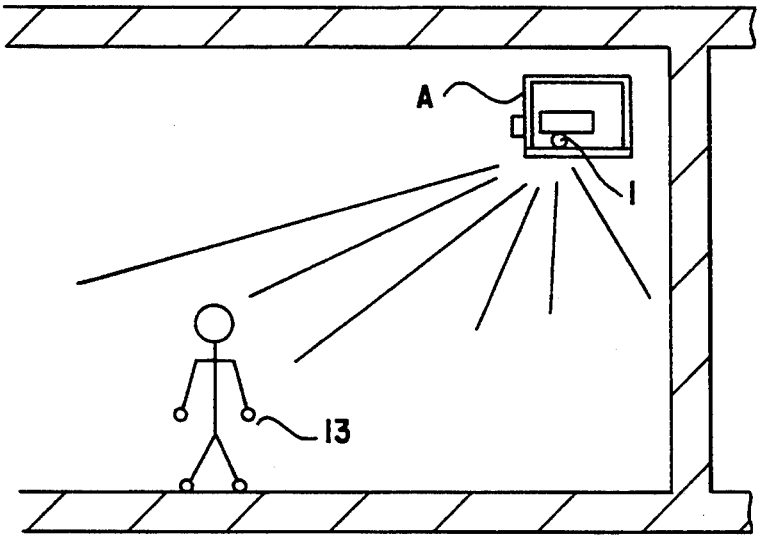
FIG. 1 is a schematic diagram showing an embodiment of a situation where a automatic surveillance camera equipment A according to the present invention is arranged.
Figure 2:
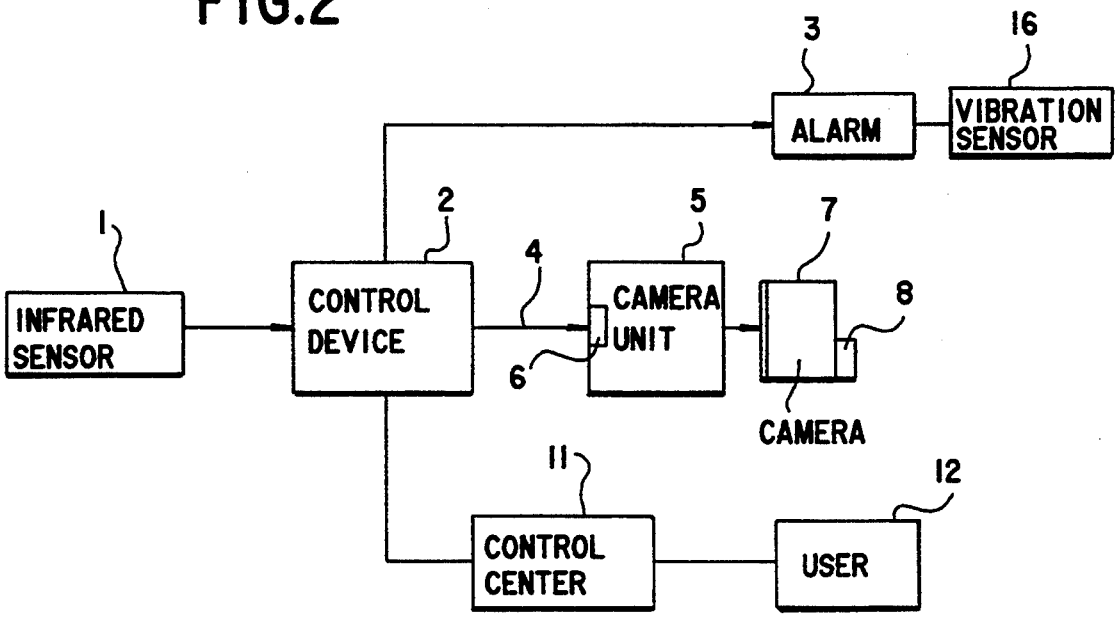
FIG. 2 is a block diagram showing components of the automatic surveillance camera equipment according to the present invention.
Figure 3:
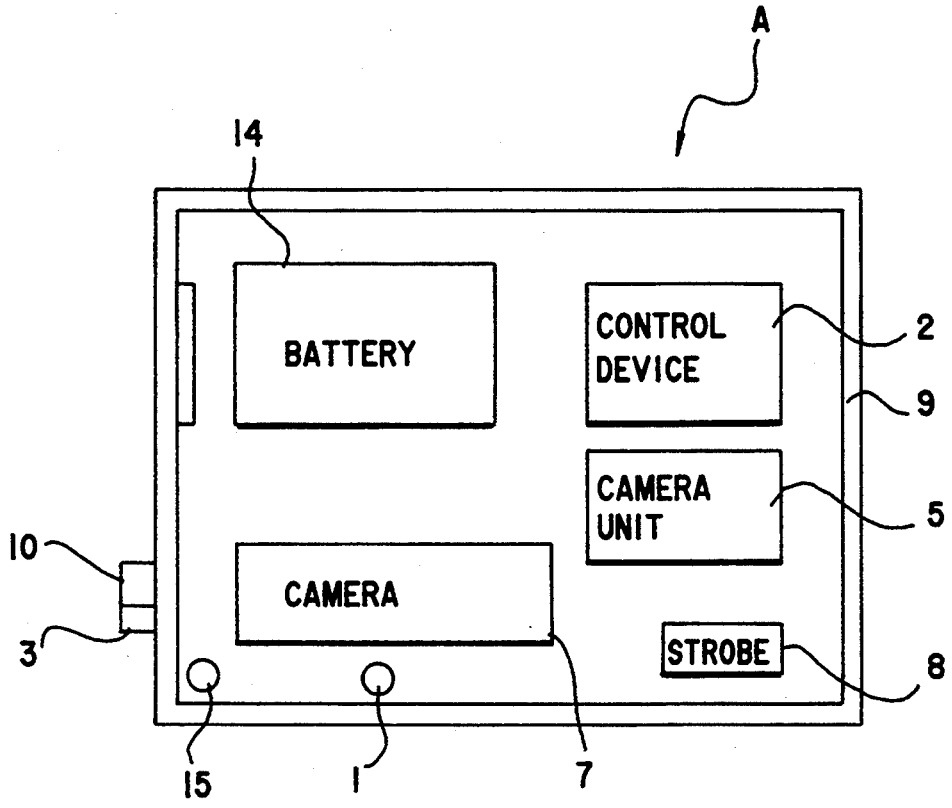
FIG. 3 is a schematic diagram showing an arrangement of an embodiment of the automatic surveillance camera equipment A according to the present invention.

FIG. 1 is a schematic diagram showing an embodiment of a situation where automatic surveillance camera equipment A according to tile present invention is arranged. FIG. 2 is a block diagram showing components of the automatic surveillance camera equipment according to the present invention. FIG. 3 is a schematic diagram showing an arrangement of an embodiment of the automatic surveillance camera equipment A according to the present invention.

Reference numeral 1 is a pyroelectricity type infrared ray detecting sensor having a plurality of sensing zones, which senses infrared rays radiating from a body of an intruder 13 when the intruder 13 enters a watching area, the sensor then sends a signal to a control device 2, and an alarm bell 3 simultaneously sounds by a command signal from the control device 2. In addition, the control device 2 notifies a control center 11 through a telephone line such as NTT (Nippon Telegram and Telephone Corporation) while at the same time with sending a command signal 4 to a camera unit 5 in response to the signal transmitted from the infrared ray detecting sensor 1. On receiving the notice, the control center 11 notifies their user 12 by telephone and requests dispatch of a patrol car.

The camera unit 5 transmits a signal to a camera 7 when receiving the command signal 4 from the control device 2, the camera then automatically performs photography by synchronizing a strobe 8 and a camera shutter each other. In response to the signal from the camera unit 5, the camera 7 follows the intruder 13 at several times each time the intruder 13 moves within the watching area, so as to take predetermined number of pictures of his figures and attitudes.

Figure 4:
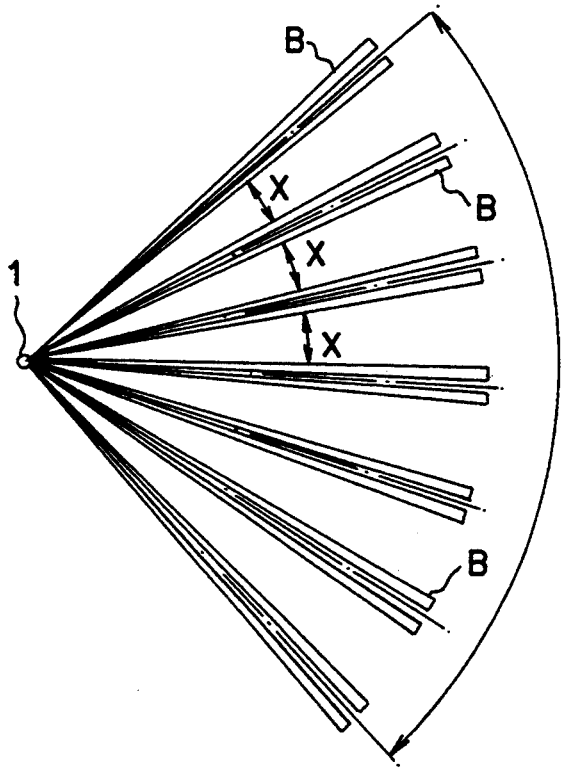
FIG. 4 is a plan view showing sensing zones of a pyroelectricity type infrared ray detecting sensor used in the automatic surveillance camera equipment according to the present invention.
Figure 5A:
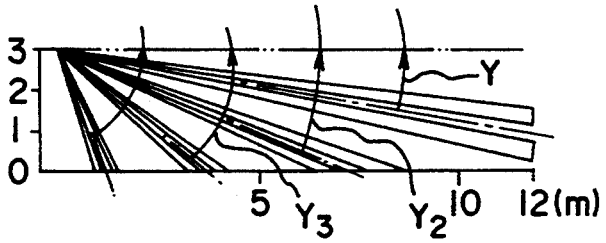
FIG. 5(*a*), FIG. 5(*b*) and FIG. 5(*c*) are side views showing sensing zones of a pyroelectricity type infrared ray detecting sensor used in the automatic surveillance camera equipment according to the present invention.
Figure 5B:
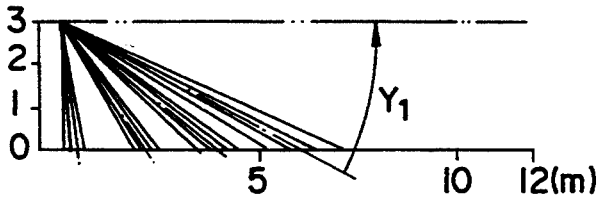
Figure 5C:
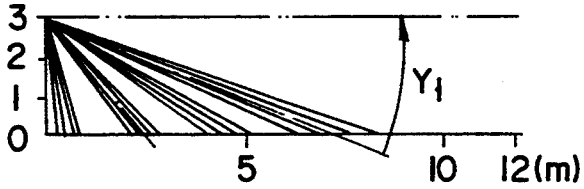

The infrared ray detecting sensor 1 preferably has a plurality of sensing zones, and a thermal type sensor such as a thermopile, a thermistor bolometer, and a pyroelectricity element can be usually used. Especially, a pyroelectricity type infrared ray detecting sensor includes a three-dimensional watching area, for example, as shown in FIG. 4, FIG. 5(*a*), FIG. 5(*b*) and FIG. 5(*c*), and more particularly includes sensing zones B at every predetermined angle X respectively, over a horizontal range as shown in FIG. 4 of a plan view, and sensing zones C at each of predetermined angle $Y_1$, $Y_2$, $Y_3$, . . . , respectively, over a vertical range as shown in FIG. 5 of a side view. In particular, a passive infrared ray detecting sensor may be used as a pyroelectricity type infrared ray detecting sensor. Moreover, depending on the situation of a mounting position of the automatic surveillance camera equipment according to the present invention, it is also possible to set the maximum watching distance in the horizontal direction or in the vertical direction. As the infrared ray detecting sensor can sense an intruder every time when he moves between sensing zones, using the infrared ray detecting sensor allows taking a plurality of pictures of his figures and attitudes within a watching area at a variety of angles.

The camera 7 is in such a way that an exposed roll film may be automatically rewound so as to be automatically held in a patrone when another roll of film is loaded into the camera. Moreover, a date, hour, and minute of the photography is automatically recorded on the exposed film, and a pilot lamp is lit when automatically continuous photography has been completed. The camera 7 is equipped with a rated 300 volts strobe 8 so as to supply electric power raised to 300 volts. Alternatively, the camera, strobe, and so on can be replaced with an infrared camera and infrared strobe which are capable of photographing even in a dark field condition. In addition, the equipment of the embodiment contains all major devices such as the infrared sensor 1, control device 2, camera unit 5, camera 7, strobe 8, battery 14, etc. within a protective case 9 together in order to prevent the automatic surveillance camera from being broken or removed by an intruder 13. When the intruder touches the protective case 9 to break down the case 9, a vibration sensor 16 operates and a threatening alarm bell 10 sounds to make him escape or otherwise moving away.

Moreover, each of the devices can start and operate with the aid of a backup device including a built-in charging battery 14 even in a power outage, and also permits the equipment can cope with the situation when wiring is cut off by an intruder. A negative color film is loaded in camera 7 so as to photograph the intruder exactly.

In FIG. 3, reference numeral 15 shows a light-receiving section (element). The light-receiving section 15 is provided with the automatic surveillance camera equipment A, and it is possible to operate the camera equipment A from outside by transmitting a signal from an outside light emitting device (not shown) to the light-receiving section 15.

In the automatic surveillance camera equipment according to the present invention, the infrared ray detecting sensor senses an intruder when he enters, then transmits a command signal to the camera unit through the control device, and the camera quickly responds to the command signal and can quickly performs automatically continuous photography of distinct image pictures having high resolution without overlooking any minute evidence by synchronizing the strobe and camera shutter with each other.

Especially, the infrared ray detecting sensor of the present invention has a plurality of sensing zones which can sense over a wide angle, and senses and outputs a signal every time an intruder moves between zones, therefore, the sensor is very effective in catching motion of the intruder exactly in all its directions and reading his figures and behavior. The automatic surveillance camera equipment of the present invention does not take a plurality of pictures of the same attitude at a time of sensing continuously like a conventional crime-prevention camera system, but shoots only when the intruder moves between zones, thus, film can be economically used.

When an intruder enters in night, the strobe and camera shutter are synchronized with each other by a command signal transmitted from an infrared sensor even in the darkness where there is no illuminating facilities, then distinct pictures of high resolution maybe obtained. Loading an infrared film and infrared strobe enables photography to be made without being suspected by an intruder.

Additionally, the automatic surveillance camera equipment according to the present invention contains major devices such as an infrared sensor, a control device, a camera, a camera unit, a strobe etc. together in a protective case, and further a battery in the protective case if necessary, so as to eliminate the need for outside; wiring of the equipment and can prevent the equipment from failing due to cutting off wiring by an intruder, and also the cost of wiring may be reduced.

What is claimed is:

1. An automatic surveillance camera equipment, comprising:

an infrared ray detecting sensor having a plurality of sensing zones, and which transmits a signal to a control device each time an intruder enters one of said sensing zones;

a control device for sending a command signal to a camera unit in response to the signal from the infrared ray detecting sensor;

a camera unit for supplying a response signal to a camera in response to the command signal from the control device;

a camera for synchronizing a strobe and a camera shutter with each other by the response signal from the camera unit, automatically photographing the intruder, and automatically rewinding a film simultaneously; and a protective case for accommodating the infrared ray detecting sensor, the control device, the camera unit and the camera together, whereby the equipment photographs an intruder in each of the sensing zones of the infrared ray detecting sensor when the intruder enters the sensing zone.

2. An automatic surveillance camera equipment according to claim 1, further comprising a built-in battery which operates automatically when a power supply from outside stops.

3. An automatic surveillance camera equipment according to claim 1, wherein a film is automatically rewound when another film is loaded in the camera, and said exposed film is automatically held into a patrone.

4. An automatic surveillance camera equipment according to claim 1, wherein a threatening alarm bell operates simultaneously when an intruder enters a watching area.

5. An automatic surveillance camera equipment according to claim 1, further comprising a vibration sensor and a threatening alarm bell which are operative when an intruder touches said protective case.

6. An alarm system, comprising an infrared ray detecting sensor having a plurality of sensing zones, and which transmits a signal to a control device each time an intruder enters one of said sensing zones;

a control device for sending a command signal to a camera unit in response to the signal from the infrared ray detecting sensor;

a camera unit for supplying a response signal to a camera in response to the command signal from the control device;

a camera for synchronizing a strobe and a camera shutter with each other by the response signal from the camera unit, automatically photographing the intruder, and automatically rewinding a film simultaneously;

a protective case for accommodating the infrared ray detecting sensor, the control device, the camera unit and the camera together; and a transmitting means for directly sending a signal from the infrared ray detecting sensor to the outside through a telephone line, whereby the camera photographs an intruder in each of the sensing zones of the infrared ray detecting sensor when the intruder enters the sensing zone.

7. An automatic surveillance camera equipment according to claim 6, further comprising a vibration sensor and an alarm bell which are operative when an intruder contacts said protective case.

8. An automatic surveillance camera equipment, comprising:

an infrared ray detecting sensor having a plurality of sensing zones, and which transmits a signal to a control device each time an intruder enters one of said sensing zones;

a control device for sending a command signal to a camera unit in response to the signal from the infrared ray detecting sensor;

a camera unit for supplying a response signal to a camera in response to the command signal from the control device;

a camera for synchronizing a strobe and a camera shutter with each other by the response signal from the camera unit, automatically photographing the intruder, and automatically rewinding a film simultaneously;

a protective case for accommodating the infrared ray detecting sensor, the control device, the camera unit and the camera together, and a battery provided in said protective case for supplying power to said camera surveillance equipment when external power is interrupted, whereby the camera photographs an intruder in each of the sensing zones of the infrared ray detecting sensor when the intruder enters the sensing zone.

* * * * *